United States Patent [19]

Jaworski et al.

[11] 4,251,075

[45] Feb. 17, 1981

[54] MAZE GAME APPARATUS

[75] Inventors: Eugene Jaworski, Park Ridge; Jeffrey D. Breslow, Highland Park, both of Ill.

[73] Assignee: Marvin Glass & Associates, Chicago, Ill.

[21] Appl. No.: 56,597

[22] Filed: Jul. 11, 1979

[51] Int. Cl.[3] ..... A63F 7/04

[52] U.S. Cl. ..... 273/113

[58] Field of Search ..... 273/113, 116, 115, 118 R, 273/123 R, 109, 144 A, 110

[56] References Cited

U.S. PATENT DOCUMENTS

| | | | |
|---|---|---|---|
| 859,767 | 7/1907 | Harris | 273/113 |
| 2,061,135 | 11/1936 | Bissiri et al. | 273/144 A |
| 2,390,458 | 12/1945 | Pedersen | 273/115 |
| 2,788,974 | 4/1957 | Pick | 273/115 |
| 3,552,750 | 1/1971 | Lomberk et al. | 273/113 X |
| 4,066,265 | 1/1978 | Bredlau | 273/113 X |

FOREIGN PATENT DOCUMENTS

| | | | |
|---|---|---|---|
| 463624 | 8/1928 | Fed. Rep. of Germany | 273/113 |

*Primary Examiner*—Richard C. Pinkham
*Assistant Examiner*—Scott L. Brown
*Attorney, Agent, or Firm*—Mason, Kolehmainen, Rathburn & Wyss

[57] ABSTRACT

A new and improved maze game apparatus comprises a playing surface for supporting a ball rolling along upstanding walls defining a maze for providing a plurality of interconnected ball directing travel paths. One of the paths leads all the way between an inlet or starting position and an outlet or discharge position. One or more paths are defined by the maze and provide dead ends, traps and other pitfalls along the way. The playing surface is supported on a hollow, convexly curved, downwardly projecting hollow wall preferably in the form of a hemisphere of clear, plastic adapted to rockably support the playing surface above a floor, table or other surface so that the playing surface may be manually tilted to direct and control a rolling ball along a selected travel path in the maze.

13 Claims, 3 Drawing Figures

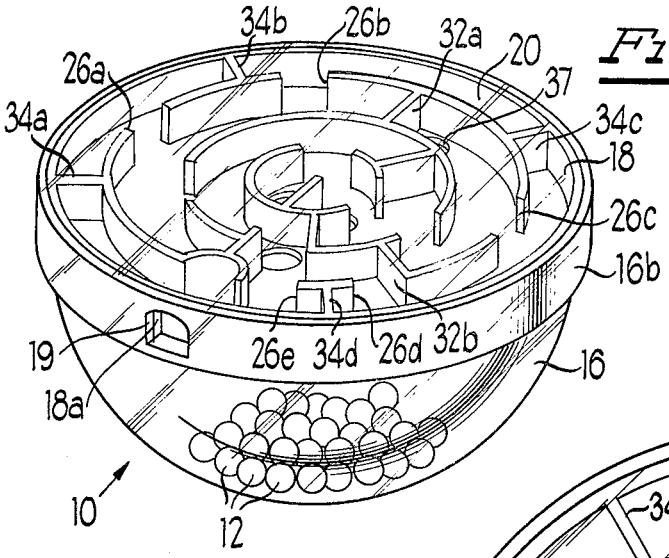
Fig 1
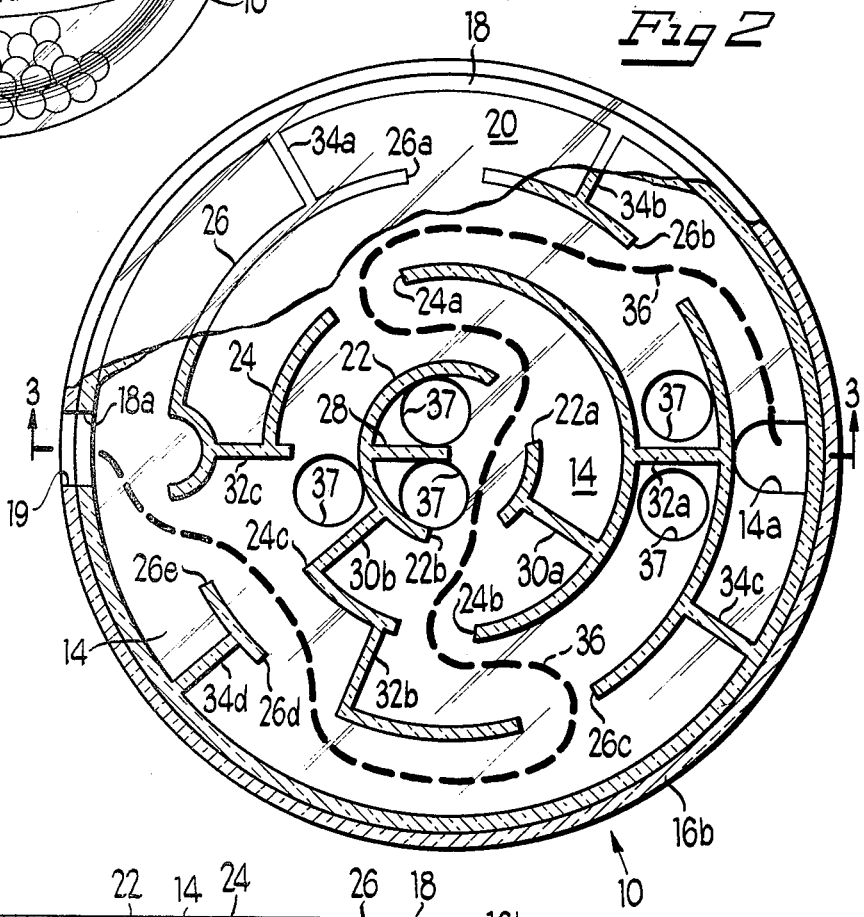
Fig 2
Fig 3
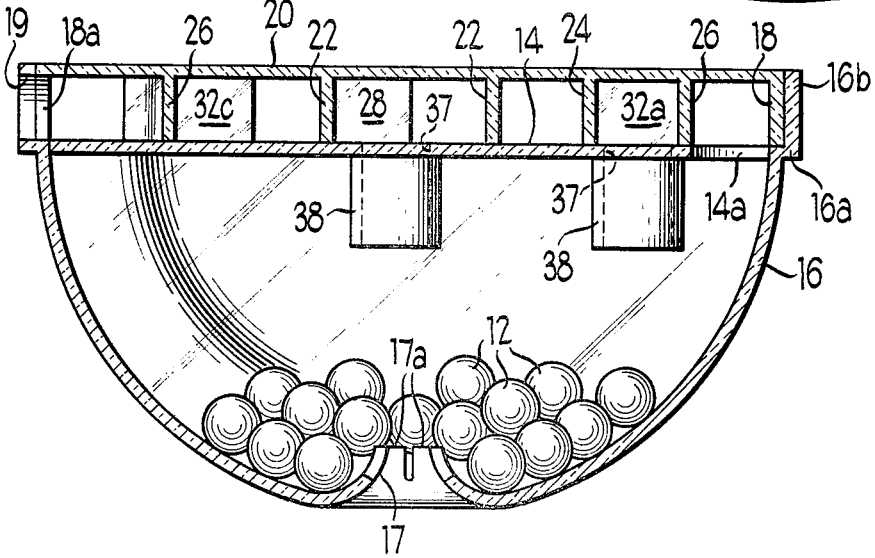

MAZE GAME APPARATUS

BACKGROUND OF THE INVENTION

1. Field of the Invention

The present invention relates to a new and improved maze game apparatus and more particularly a novel game apparatus comprising a playing surface and wall defining a maze structure for supporting a rolling ball which is directed along travel paths defined by the maze walls. One of the paths leads all the way between an inlet position and an outlet position and one or more paths provide dead ends, traps and other impediments for the ball along the way. The playing surface is supported for manual rocking movement on a hollow, convexly, curved, support structure of hemisphere shape and suitable for receiving and containing balls for use in the game.

2. Description of the Prior Art

A wide variety of maze games have been developed to provide entertainment and improve manual dexterity or skill. A common maze game includes a gimbal supported playing surface mounted in a box and manipulated by a pair of control knobs to tilt the playing surface about a pair of transversely intersecting, generally horizontally disposed pivot axes.

OBJECTS OF THE PRESENT INVENTION

It is an object of the present invention to provide a new and improved maze game apparatus.

More particularly, it is an object to provide a new and improved maze game apparatus having a greatly simplified means for controlling the tilt of the playing surface which supports a rolling ball traveling through the maze.

Yet another object of the present invention is to provide a new and improved maze game type apparatus of the character described having novel means permitting the playing surface to be manually pivoted about transversely intersecting, generally horizontal, tilt axes for controlling the rolling direction and speed of a ball while traveling through the maze.

Another object of the present invention is to provide a new and improved maze game apparatus of the type described wherein a circular playing surface is supported on a generally hemispherically shaped, hollow housing which is adapted to rest on any convenient supporting surface and is easily tilted or rocked to direct a rolling ball along selected travel paths in the maze.

Yet another object of the present invention is to provide a new and improved maze game apparatus wherein a rockable support base for the playing surface of the maze provides a convenient container for receiving the balls falling into traps while traveling the paths of the maze.

Still another object of the present invention is to provide a new and improved maze game apparatus wherein a hollow hemisphere shaped base provides an easy way of tilting the playing surface to control the speed and direction of ball travel and in addition, provides a receptacle for storing the balls which are not in use or do not successfully reach the outlet or finish position at the end of the maze.

Still another object of the present invention is to provide a new and improved maze game apparatus of the character described wherein a playing surface for supporting a rolling ball is formed with one or more slots for entrapping a ball and returning it to the interior of a support base compartment below the playing surface.

Yet another object of the present invention is to provide a new and improved maze game apparatus of the type described wherein means is provided for preventing a ball in a containing receptacle below the playing surface from passing outwardly onto the playing surface when the surface is tilted.

BRIEF SUMMARY OF THE INVENTION

The foregoing and other objects and advantages of the present invention are accomplished in an illustrated embodiment comprising a maze game apparatus including a playing surface with a maze defined thereon for supporting a rolling ball which is controlled by tilting of the playing surface. Upstanding walls are provided on the playing surface to define a maze having a plurality of interconnected, ball directing travel paths extending generally between an inlet or starting position and an outlet or finish position. One of the paths leads all the way between the start and finish positions and at least one or more travel paths is fraught with dead ends, traps and other impediments to the successful passage of a ball between the inlet and outlet position. A novel support base structure is provided below the playing surface with a hemisphere shape adapted to permit the playing surface to be manually rocked about one or more generally horizontal, intersecting tilt axes for controlling the speed and direction of a ball rolling along a selected travel path in the maze. The hemisphere base provides a convenient receptacle for receiving balls which fall through traps in the playing surface and for containing a supply of balls to be used in the game.

BRIEF DESCRIPTION OF THE DRAWINGS

For a better understanding of the present invention, reference should be had to the following detailed description taken in conjunction with the drawings, in which:

FIG. 1 is a perspective view looking downwardly at a new and improved maze game apparatus constructed in accordance with the features of the present invention;

FIG. 2 is a top plan view of the maze game apparatus of FIG. 1 with portions cut away for better clarity and understanding; and FIG. 3 is a diametrically disposed vertical cross-sectional view taken substantially along lines 3—3 of FIG. 2.

DESCRIPTION OF THE PREFERRED EMBODIMENT

Referring now more particularly to the drawings, therein is illustrated a new and improved maze game apparatus constructed in accordance with the features of the present invention and referred to generally by the reference numeral 10. The apparatus includes a plurality of spherical balls or marbles 12 adapted to roll over a tiltable, circular shaped, playing surface 14 which is mounted on the upper end of a hollow hemisphere 16 providing a supporting base structure. Preferably, the base is formed of transparent, plastic material so that the balls or marbles are readily visible from the exterior thereof.

As indicated best in FIG. 3, around the upper edge, the hemisphere is formed with an outwardly extending annular radial flange **16*a* and an integrally formed, upstanding cylindrically shaped peripheral wall 16b** is joined therewith.

The flange 16a and wall 16b form a cylindrical recess for supporting a maze defining structure comprising a cylindrical outer ring or wall 18 formed to depend from the bottom of the outer peripheral edge of a clear plastic cover or circular top wall 20. A plurality of depending, intermediate, concentrically disposed ring-like wall segments 22, 24, 26, etc. spaced radially outwardly of a central axis depend from the cover or top wall. The ring-like wall segments 22, 24 and 26 are formed in arcuate segments of various angular extent and define radially spaced wall openings 22a, 22b, 24a, 24b, 24c, 26a, 26b, 26c, 26d, 26e, etc. which provide passages between the concentric ring-like paths formed by the wall segments between the circular playing surface 14 and the cover 20.

In addition to the concentric, arcuate ring-like walls 22, 24 and 26, there are also provided a plurality of radially extending wall segments 28, 30a and 30b, 32a, 32b, 32c, 34a, 34b and 34c, 34d, etc. which interconnect the concentric rings. These arcuate walls or rings and radial walls define a maze structure between the circular playing surface 14 and the cover 20 providing a plurality of tortuous paths for the rolling balls 12 as the direction and speed of the balls is manipulated and controlled by manual rocking of hemisphere housing or base 16. The spherical shape of the base permits the surface 14 to be tilted in any desired direction about one or more generally horizontal, transversely intersecting tilt axes.

It is an object of play when using the maze game apparatus 10 to direct and control a rolling ball 12 moving from an inlet or starting position comprising a slot or opening 14a on one side of the playing surface 14. The slot 14a provides a passage between the maze structure above the playing surface and the hemisphere, supporting base structure 16. The maze of wall segments between the playing surface and the top 20 provide at least one continuous travel path 36 designated by the dotted line in FIG. 2 leading all the way from the starting position 14a to an exit or finish position formed adjacent a slot 18a on the opposite side of the playing surface. The slot or opening 18a is formed in the circular ring-like wall 18 and a matching slot 19 is formed in the upstanding wall portion 16b of the base 16.

In playing the game, a player tilts the playing surface 14 by rocking the base 16 until a ball 12 contained in the base rolls up through the starting slot 14a onto the circular playing surface. Then by precision manipulation of the direction and amount of tilt on the playing surface, the player causes the ball to roll along the continuous path 36 as rapidly as possible to reach the exit opening 18a and 19 without becoming temporarily displaced, in one or more of several dead end or ball trapping compartments defined by the various wall elements of the maze. In addition to the several dead end compartments formed by the arcuate wall segments 22, 24, 26 and the radial segments 28, 30, 32 and 34, etc., the maze also is provided with slots of circular shape 37 in the playing surface 14 at various locations. As illustrated, some of the slots 37 are provided in dead end compartments or portions of the maze that do not form a continuous passage between the starting position and the finish. These openings 37 are slightly larger in diameter than the balls 12 which may drop downwardly through the openings into the hollow base structure 16. In order to minimize the possibility of any balls contained in the base 16 from inadvertently passing upwardly through the circular trap openings 37 and onto the playing surface 14, there is provided a cylindrical tube 38 around each of the openings. The tubes form a sort of check valve or one-way passage downwardly from the circular playing surface 14 into the base 16. The balls or marbles 12 may be conveniently stored in the hollow interior of the hemisphere support base 16 and an opening 17 is provided in the base at the center of the bottom. The opening includes a generally frustoconically shaped wall structure with radially segmented upper wall sections 17a. These sections normally define an opening smaller than the diameter of a ball but are deflectable outwardly by a ball as it is pressed upwardly into the base compartment. Because the diameter of the upper end of the opening forming structure 17 is slightly smaller than the diameter of the balls, the balls are prevented from passing out of the base 16 during play.

In playing a game, a ball is moved up from the base 16 to the starting position or slot 14a and is then rolled on the surface 14 as shown in FIGS. 1 and 3 toward the outlet or finish slot 18a. Initially, a player tilts the surface 14 to a substantial angle to move one of the balls from the base 16 through the starting inlet opening 14a onto the upper surface of the playing surface 14 of the maze-like structure. The tilt angle is subsequently reduced somewhat to direct and control the rolling travel of the ball along the surface 14 on the successful path 36. A player tries to roll the ball as rapidly as possible along the surface to best avoid dead end compartments and openings 37. When the ball finally reaches the finish position, it passes out through the finish slot 18a and 19 to complete the run.

The ball is directed and controlled by manual movement of the base structure 16 to tilt or rock the playing surface 14 as desired in order to achieve the desired direction and velocity for the rolling ball as it moves through the maze structure. The depending tubes 38 act as check valves to prevent balls 12 contained in the hollow support base 16 from passing onto the playing surface 14 during manipulation by a player. The compartment 16 provides a convenient storage chamber for the marbles or the balls both during play and when the game is not in use. It will thus be seen that the maze game apparatus resembles an inverted "Gum Ball" machine in that a plurality of balls 12 of different colors are contained in a hollow, hemisphere of clear plastic 16. The novel method of rocking movement to control and direct a ball on the surface 14 to move through the maze defining wall structure is fun and exciting. The game requires dexterity and manual skill which may be developed and improved through play with the apparatus 10 of the present invention.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Maze game apparatus comprising:

at least one spherical ball;

a playing surface for supporting said ball while rolling;

upstanding wall means defining a maze upwardly of said surface providing a plurality of interconnected ball directing travel paths for said rolling ball, one of which paths communicates all the way between an inlet opening and an outlet position, and at least one other path in communication therewith, yet not providing complete communication all the way between said inlet opening and said outlet position;

a support base for said playing surface comprising a hollow, convexly curved wall extending downwardly of said playing surface adapted to rockably contact a supporting floor or the like permitting manual tilting of said playing surface for directing said ball to roll along selected ones of said travel paths of said maze between said inlet opening and outlet position; and said inlet opening in communication with said curved wall permitting a ball to pass from said curved wall onto said playing surface into said one path.

2. The maze game apparatus of claim 1 wherein said support base includes a lower surface shaped like a portion of a spherical surface.

3. The maze game apparatus of claim 1 or 2 wherein said playing surface and support base define an enclosure for containing at least one ball.

4. The maze game apparatus of claim 3 wherein said support base includes inlet opening means for passing balls inserted into said enclosure from outside.

5. The maze game apparatus of claim 4 wherein said inlet opening means includes at least one deflectable wall for permitting the passing of a ball into said enclosure from outside and preventing any ball contained in said enclosure from passing to the outside through said inlet opening.

6. The maze game apparatus of claim 3 wherein said support base has at least a portion thereof formed of transparent material for viewing a ball contained in said enclosure.

7. The maze game apparatus of claim 3 wherein said playing surface is circular and said enclosure is substantially hemispherical in shape.

8. The maze game apparatus of claim 3 wherein said outlet position is defined by an outlet opening in said wall means defining said one path.

9. The maze game apparatus of claim 8 wherein said outlet opening is positioned adjacent an outer perimeter of said playing surface.

10. The maze game apparatus of claim 3 wherein said playing surface is formed with at least one discharge opening for returning a ball from a travel path of said maze back to said enclosure before said ball reaches said outlet position.

11. The maze game apparatus of claim 10 including a discharge chute in communication with said discharge opening depending downwardly of said playing surface into said enclosure for normally preventing a ball from moving from said enclosure onto said playing surface through said discharge opening.

12. The maze game apparatus of claim 10 wherein said discharge opening is positioned in said other travel path of said maze.

13. The maze game apparatus of claim 10 including a plurality of said discharge openings on said playing surface, at least one of said discharge openings positioned adjacent said one travel path and at least another of said discharge openings positioned adjacent said other travel path.

* * * * *